US006349942B1

(12) United States Patent
Solboe

(10) Patent No.: US 6,349,942 B1
(45) Date of Patent: Feb. 26, 2002

(54) BOARD GAME FOR GUESSING INFORMATION ABOUT A TOPIC AREA

(76) Inventor: William L. Solboe, 4209 N. Murray Ave., Shorewood, WI (US) 53211

( * ) Notice: Subject to any disclaimer, the term of this patent is extended or adjusted under 35 U.S.C. 154(b) by 0 days.

(21) Appl. No.: 09/629,338

(22) Filed: Aug. 1, 2000

Related U.S. Application Data

(60) Provisional application No. 60/147,448, filed on Aug. 5, 1999.

(51) Int. Cl.[7] ..... A63F 1/00
(52) U.S. Cl. ..... 273/243; 273/430
(58) Field of Search ..... 273/242, 243, 273/246, 429, 430, 431, 432, 236, 244

(56) References Cited

U.S. PATENT DOCUMENTS 1,209,373 A * 12/1916 Zarker
3,589,729 A * 6/1971 Girard
3,966,211 A * 6/1976 Brown
4,953,869 A * 9/1990 Muhammad
5,507,497 A * 4/1996 Sivak
5,516,111 A * 5/1996 Strickland
5,893,561 A 4/1999 Hoffman
5,913,518 A * 6/1999 Bemlow
6,279,909 B1 * 8/2001 Alexander

* cited by examiner

*Primary Examiner*—Benjamin H. Layno
*Assistant Examiner*—Vishu K Mendiratta
(74) *Attorney, Agent, or Firm*—Donald J. Ersler

(57) ABSTRACT

In a preferred embodiment, a board game for guessing song titles and artists includes a game board, spinner, timer, and a plurality of game pieces. The game board preferably has a scoring area on one end and a spinner area on the other end thereof. The scoring area allows the plurality of the game pieces to be used therein. The spinner area has an area for mounting the spinner. The area surrounding the spinner has a plurality of playing categories. Each player or team places a game piece in the start position of the scoring area. Each player or team takes turns rotating the spinner. The spinner will point to one of a plurality of playing categories. A person acting as a disc jockey, but not playing the game, will play the songs on a music source. Depending upon the category pointed to by the spinner, the participant will implement the prescribed action. When the title and artist of the song are correctly guessed; the next player or team rotates the spinner. The timer is used by the disc jockey to signal when time has expired for an individual player or team to guess the correct answers alone. The disc jockey announces the word "Mayhem" to indicate when time has expired and the other players or teams also have the opportunity to guess the answer(s). The first player or team to reach the maximum number of points wins the game.

12 Claims, 2 Drawing Sheets

BOARD GAME FOR GUESSING INFORMATION ABOUT A TOPIC AREA

CROSS-REFERENCES TO RELATED APPLICATIONS

This is a utility application, having priority from provisional patent application, serial No. 60/147,448 filed on Aug. 5, 1999.

BACKGROUND OF THE INVENTION

1. Field of the Invention

The present invention relates generally to board games and more specifically to a board game for guessing information about a topic area utilizing unique play categories and scoring system.

2. Discussion of the Prior Art

There are a variety of board games devoted to numerous topic areas. However, there appears to be no other board game which allows the players to guess information about topic areas utilizing unique playing categories and with information of the players choice.

Accordingly, there is a clearly felt need in the art for a board game for guessing information about a topic area using a clever and competitive scoring system.

SUMMARY OF THE INVENTION

The present invention provides a board game for guessing information about a topic area which utilizes unique play categories, scoring system, and allows the players to use information of their own choice. There are many different informational topics which may be used as material for playing the board game. A preferred way of playing the board game is the identification of recorded music. This patent application will use a board game for guessing the song titles and artists to illustrate the functionality of the board for guessing information about a particular topic area.

A board game for guessing song titles and artists includes a game board, spinner, timer, and a plurality of game pieces. The game board preferably has a scoring area on one end and a spinner area on the other end thereof. The scoring area allows the plurality of the game pieces to be used therein. The spinner area has an area for mounting the spinner. The area surrounding the spinner has a plurality of playing categories. Each player or team places a game piece in the start position of the scoring area. From henceforth, a player or team will be referred to as a participant. Each participant takes turns rotating the spinner. The spinner will point to one of a plurality of playing categories.

A person acting as a disc jockey, but not playing the game, will play the songs on a music source. Depending upon the category pointed to by the spinner, the participant will implement the prescribed action. When the title and artist of the song are correctly guessed; the next participant rotates the spinner. The timer is used by the disc jockey to signal when time has expired for an individual participant to guess the correct answers alone. The disc jockey announces the word "Mayhem" to indicate when time has expired and the other participants also have the opportunity to guess the answer(s). The first participant to reach the maximum number of points wins the game. An alternative to the board game is one on one play between a single participant and a music jockey.

Accordingly, it is an object of the present invention to provide a board game for guessing information about a topic area which allows participants to use an information source of their own choice.

It is a further object of the present invention to provide a board game for guessing information about a topic area which utilizes unique play categories.

It is yet a further object of the present invention to provide a board game for guessing information about a topic area which utilizes a unique scoring system.

Finally, it is another object of the present invention to provide a board game for guessing song titles and artists which allows any type of music to be used.

These and additional objects, advantages, features and benefits of the present invention will become apparent from the following specification.

DETAILED DESCRIPTION OF THE PREFERRED EMBODIMENTS

Figure 1:
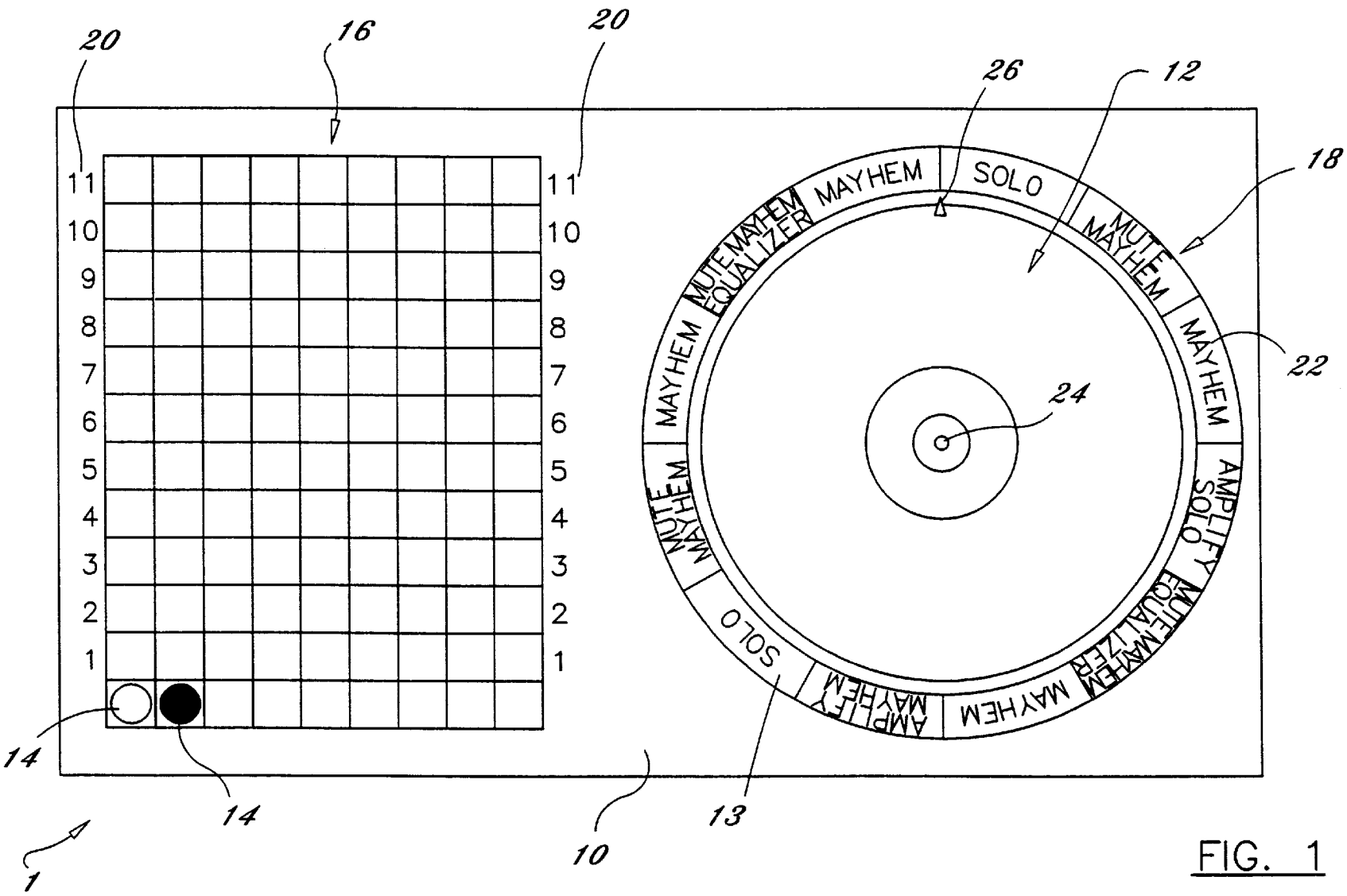
FIG. 1 is a top view of a game board of the board game for guessing song titles and artists in accordance with the present invention.
Figure 2:
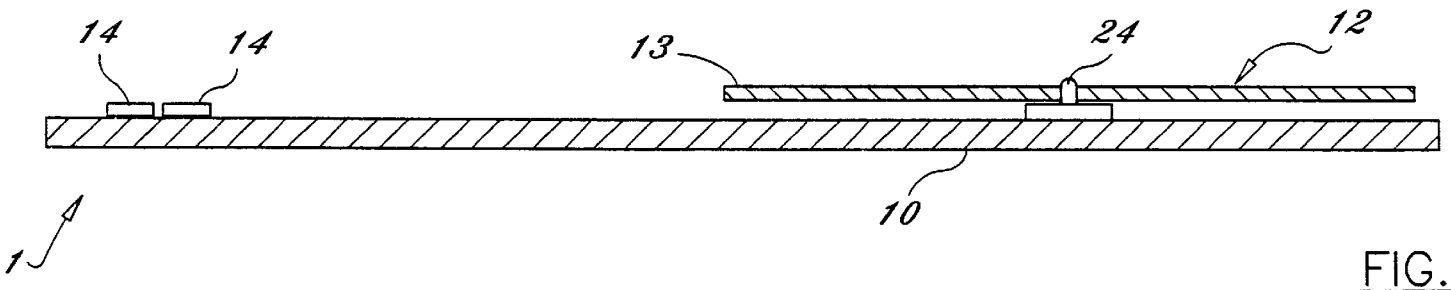
FIG. 2 is a side view of a game board of the board game for guessing song titles and artists in accordance with the present invention.

With reference now to the drawings, and particularly to FIG. 1, there is shown a top view of a game board 10 of the board game for guessing song titles and artists 1. With reference to FIG. 2, a board game for guessing song titles and artists 1 includes a game board 10, spinner 12, timer, and a plurality of game pieces 14. The game board 10 preferably has a scoring area 16 on one end and a spinner area 18 on the other end thereof. The scoring area 16 allows a plurality of the game pieces 14 to used thereupon. The game pieces 14 are preferably guitar picks, but could be any item which has been or will be used for a game piece. The scoring area 16 may be graphically designed in any particular way. The first participant to obtain the maximum number of points at the top of the point column 20 wins the game. The spinner area 18 preferably includes the spinner 12, and a plurality of playing categories 22. The spinner 12 preferably includes a disc 13 and a spindle 24. The plurality of playing categories 22 are located in an area surrounding the spinner 12. A bottom of the spindle 24 is mounted to the game board 10 in the spinner area 18. The disc 13 is placed over a top of the spindle 24. The disc 13 is freely rotable relative to the spindle 24. A pointer 26 is formed on a circumference of the disc 13.

Figure 3:
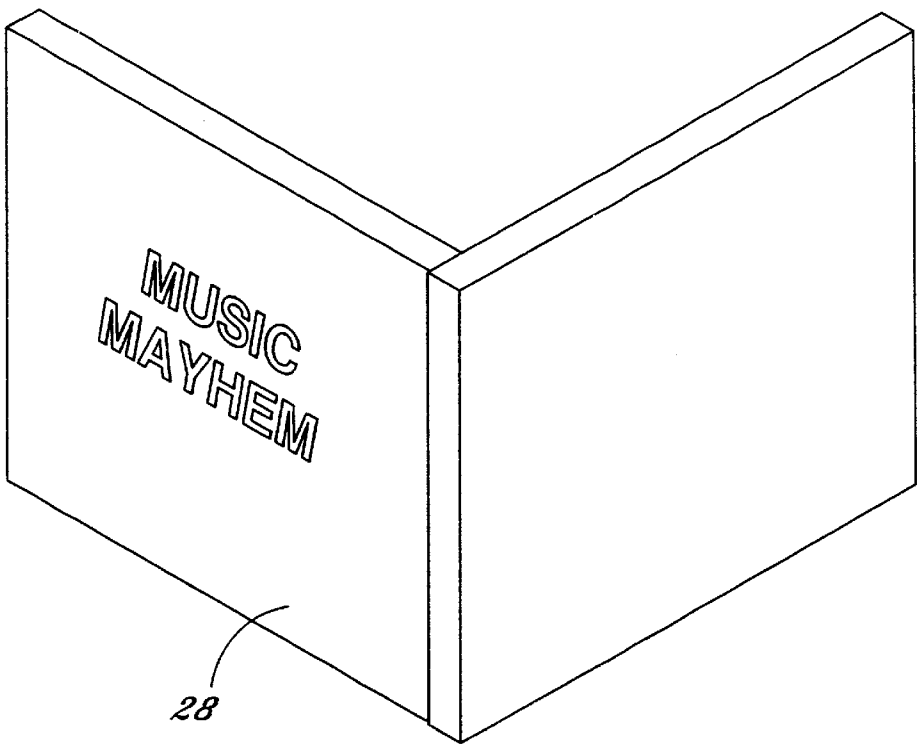
FIG. 3 is a perspective view of a game box used to hide the activities of the disc jockey in accordance with the present invention.

The game requires at least three participants; a music source such as a compact disc player, phonograph, or tape deck; and compact discs, records, or tapes. The music source may be replaced with a radio, computer, television, or internet access. There must be a disc jockey who plays the music, but does not play the game, and at least two other participants. With reference to FIG. 3, the disc jockey may use a game box 28 to hide their activities from the participants. In one variation of the standard game, the disc jockey is allowed to hum the song instead of playing pre-recorded music. Any type of music that the participants agree upon may be played. It is recommended that a single type of music be used, or music from a particular era. If the participants cannot answer within an agreed upon time period, the participants may give up, the disc jockey may then give hints, or the disc jockey may then help by spelling out the artist name and/or song title slowly, letter by letter until the answers are correctly guessed.

Preferably, the game is started by positioning the participants around the game board 10. The disc jockey rotates the spinner 12. Which ever participant that is closest to the pointer 26 of the spinner 12 goes first. The order of the succeeding participants are determined in a clockwise rotation. One point is preferably given for guessing the correct artist of a song and one point is preferably given for guessing the correct title of a song. It is possible that one participant guesses the correct title while another participant guesses the correct artist. Play begins when the first participant rotates the spinner 12. The pointer 26 will come to rest on one of preferably six playing categories: Mayhem, Amplify Mayhem, Mute Mayhem, Solo, Amplify Solo, or Equalizer.

In Mayhem, the timer is not used; the disc jockey starts the music and all participants are allowed to guess the artist and/or song title. The first participant to correctly identified the artist and/or title earns one point for each correct answer. Amplify Mayhem is the same as Mayhem, except that the point values are doubled for each correct answer. Mute Mayhem is the same as Mayhem, except the active participant chooses a particular participant who is eliminated from participating in guessing of the artist or title for the duration of that song. The particular participant is "muted" or not allowed to answer the question.

In Solo, only the participant that spun and landed on Solo is allowed to guess preferably for the first 15 seconds of the song. The disc jockey uses a timer to measure the 15 second time period. After the timer runs out, the disc jockey announces the word "Mayhem;" if the active participant has not guessed the artist and/or title of the song, the other participants will also be allowed to guess the artist and title of the song. Amplify Solo is the same as Solo, except that point values are doubled. The active participant is the one rotating the spinner 12.

In Equalizer/Mute Mayhem, when a participant lands on this category, the participant(s) in first place is "muted" or not allowed to guess for the duration of that song, regardless of who spun the spinner 12. If all participants are tied, then Equalizer is played as a normal Mayhem category.

The timer is preferably of the hour glass variety; sand runs through a thin opening for 15 seconds. Each participant moves their game piece in response to receiving points. The "active" participant is the participant rotating the spinner 12.

There are at least four alternatives to the music game. The first music alternative is Karaoke Style. The disc jockey is used along with another non-participant who's chosen to be the singer. The singer listens to the music on headphones and sings the song to the other participants who guess as in the standard game.

The second music alternative is Written Style. The answers are written rather than shouted out. Each participant writes their name preferably on two answer sheets before the start of each song. The active participant rotates the spinner 12 to determine the playing category. Each participant is preferably allowed two answer sheets with a maximum of two guesses per sheet. Answer sheets are placed face down on the spinner 12. After 60 seconds, or a predetermined period of time, the disc jockey flips the stack over to determine who first identified the artist and/or title correctly. Only the first correct answers receive points.

The third music alternative is On-Air Live Style. The disc jockey is a real radio station disc jockey, a television game show host, or an interactive internet web page. The On-Air entity rotates the spinner 12 and announces the category and participant. The On-Air entity would also keep track of each participant's score. There could be two or more participants that phone-in or communicate their answers in response to the play of a particular song, following standard music play rules.

The fourth music alternative is a modification of the Solo playing category. The fourth alternative includes one participant and a disc jockey. The disc jockey plays the music and awards points for correct answers. The spinner 12 is not used, but the disc jockey plays a succession of songs for the participant to identify. The participant guesses the song title and/or artist of as many songs as they can in a predetermined time period, preferably two minutes. The participant is allowed to pass on songs. One point is preferably awarded for each correct answer. The winner may be determined as the participant that earns the most points. The fourth alterative may be used as a challenge to the winner of the standard game, winner of alternatives one through three, or it may be used in conjunction with play on the radio, over the internet, or in a television show format.

The board game for guessing the song titles and artists should not be limited to music information only, but should include guessing about any information such as history, science, math, sports, television programs, movies, foreign language, astronomy, trivia, or any other topic area. Instead having a disc jockey, there would be an information jockey who would ask the questions of the others playing the game. The information jockey may also help by spelling out an answer or giving hints to a question. One point is preferably given for guessing the correct answer to a question. The same play categories will apply. Preferably, the pointer 26 will come to rest on one of preferably six playing categories: Mayhem, Amplify Mayhem, Mute Mayhem, Solo, Amplify Solo, or Equalizer.

In Mayhem, the information jockey recites the question and all participants are allowed to guess the correct answer. The first participant to correctly answer the question earns one point for each correct answer. Amplify Mayhem is the same as Mayhem, except that the point values are doubled for each correct answer. Mute Mayhem is the same as Mayhem, except the active participant chooses another participant to be muted or not allowed to guess for the duration of that turn.

In Solo, only the participant that spun and landed on Solo is allowed to answer the question preferably for the first 15 seconds after the question is read. The information jockey uses a timer to measure the set period of time. After the timer runs out, the information jockey announces "Mayhem" to indicate that time has run out; if the active participant has not guessed the correct answer, the other participants will also be allowed to answer the question. Amplify Solo is the same as Solo, except that point values are doubled.

In Equalizer/Mute Mayhem, when a participant lands on this category, the participant in first place is "muted" or not allowed to guess for the duration of the question, regardless of who spun the spinner 12. If all participants are tied, then Equalizer is played as a normal Mayhem category.

There are at least three alternatives to the information game. The first alternative is Written Style. The answers are written rather than shouted out. Each participant writes their name on an answer sheet before the question is recited. The active participant rotates the spinner 12 to determine the playing category. Each participant is preferably allowed two answer sheets with a maximum of preferably two guesses per sheet. Answer sheets are placed face down on the spinner 12. After 60 seconds, or a predetermined period of time, the information jockey flips the stack over to determine who correctly answered the question. Only the first correct answers receive points.

The second alternative is On-Air Live Style. The information jockey is a real radio station disc jockey, a television game show host, or an interactive internet web page. The On-Air entity rotates the spinner 12 and announces the category and participant. The On-Air entity would also keep track of each participant's score. There could be two or more participants that phone in their answers in response to a particular question, following standard play rules.

The third alternative is a modification of the Solo playing category. The third alternative includes one participant and an information jockey. The information jockey recites the questions and awards points for correct answers. The spinner 12 is not used, but the information jockey recites a succession of questions for the participant to answer. The participant guesses the answers for as many questions as they can in a pre-determined time period, preferably two minutes. The participant is allowed to pass on the answering of a question. One point is preferably awarded for each correct answer. The winner may be determined as the participant that earns the most points. The third alterative may be used as a challenge to the winner of the standard game, winner of first and second alternatives, or it may be used in conjunction with play on the radio, over the internet, or in a television show format.

The music guessing and the information guessing versions of the game could be played on a syndicated radio or television show for the entertainment of those listening or watching.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method for playing a game which allows participants to guess information about a particular song, comprising the steps of:

(a) providing a plurality of game pieces;

(b) providing a game board with a scoring area and a spinner, said scoring area providing spaces for said plurality of game pieces, said spinner having a pointer disposed on a peripheral edge thereof, said spinner capable of pointing to one of at least three categories;

(c) assigning an order of play to at least two participants;

(d) rotating said spinner to determine a playing category, said spinner being rotated by one of said at least two participants;

(e) providing a first playing category which allows all participants to guess information about said particular song;

(f) providing a second playing category which allows only an active participant to guess information about said particular song for a set period of time, after said set period of time all participants being allowed to guess information about said particular song;

(g) providing a third playing category which allows said active participant to prevent at least one opposing participant from guessing information about said particular song; and (h) providing a nonparticipant who plays said particular song, at least two participants being given a set period of time to guess information about said particular song.

2. The method for playing a game which allows participants to guess information about a particular song of claim 1, further comprising the steps of:

(i) awarding said at least one participant with at least one unit of points if information about said particular song is answered correctly.

3. The method for playing a game which allows participants to guess information about a particular song of claim 1, further comprising the steps of:

(i) providing a fourth playing category which prevents at least one participant with the greatest number of points from guessing information about said particular song.

4. The method for playing a game which allows participants to guess information about a particular song of claim 1, wherein:

information about said song being the artist who performed said song.

5. The method for playing a game which allows participants to guess information about a particular song of claim 1 wherein:

information about said song being the title of the said song.

6. A method for playing a game which allows participants to guess information about a particular song, comprising the steps of:

(a) providing a plurality of game pieces;

(b) providing a game board with a scoring area and a spinner, said scoring area providing spaces for said plurality of game pieces, said spinner having a pointer disposed on a peripheral edge thereof, said spinner capable of pointing to one of at least four categories;

(c) assigning an order of play to at least two participants;

(d) rotating said spinner to determine a playing category, said spinner being rotated by one of said at least two participants;

(e) providing a first playing category which allows all participants to guess information about said particular song;

(f) providing a second playing category which allows an active participant to guess information about said particular song for a set period of time, after said set period of time all participants being allowed to guess information about said particular song;

(g) providing a third playing category which allows said active participant to prevent at least one opposing participant from guessing information about said particular song; and (h) providing a fourth playing category which prevents at least one participant with the greatest number of points from guessing information about said particular song;

(i) providing a nonparticipant who plays said particular song, at least two participants being given a set period of time to guess information about said particular song; and (j) awarding said at least one participant with at least one unit of points if information about said particular song is answered correctly.

7. The method for playing a game which allows participants to guess information about a particular song of claim 6, wherein:

information about said song being the artist who performed said song.

8. The method for playing a game which allows participants to guess information about a particular song of claim 6, wherein:

information about said song being the title of the said song.

9. A method for playing a game which allows participants to guess information about a particular topic area, comprising the steps of:

(a) providing a plurality of game pieces;

(b) providing a game board with a scoring area and a spinner, said scoring area providing spaces for said plurality of game pieces, said spinner having a pointer disposed on a peripheral edge thereof, said spinner capable of pointing to one of at least three categories;

(c) assigning an order of play to at least two participants;

(d) rotating said spinner to determine a playing category, said spinner being rotated by one of said at least two participants;

(e) providing a first playing category which allows all participants to guess information about said particular topic area;

(f) providing a second playing category which allows an active participant to guess information about said particular topic area for a set period of time, after said set period of time all participants being allowed to guess information about said particular topic area;

(g) providing a third playing category which allows said active participant to prevent at least one opposing participant from guessing information about said particular topic area; and (h) providing a nonparticipant who recites said particular topic area, at least two participants being given a set period of time to guess information about said particular topic area.

10. The method for playing a game which allows participants to guess information about a particular topic area of claim 9, further comprising the steps of:

(i) awarding said at least one participant with at least one unit of points if information about said particular topic area is answered correctly.

11. The method for playing a game which allows participants to guess information about a particular topic area of claim 9, further comprising the steps of:

(i) providing a fourth playing category which prevents at least one participant with the greatest number of points from guessing information about said particular topic area.

12. A method for playing a game which allows participants to guess information about a particular topic area, comprising the steps of:

(a) providing a plurality of game pieces;

(b) providing a game board with a scoring area and a spinner, said scoring area providing spaces for said plurality of game pieces, said spinner having a pointer disposed on a peripheral edge thereof, said spinner capable of pointing to one of at least four categories;

(c) assigning an order of play to at least two participants;

(d) rotating a spinner to determine a playing category, said spinner being rotated by one of said at least two participants;

(e) providing a first playing category which allows all participants to guess information about said particular topic area;

(f) providing a second playing category which allows an active participant to guess information about said particular topic area for a set period of time, after said set period of time all participant being allowed to guess information about said particular topic area;

(g) providing a third playing category which allows said active participant to prevent at least one opposing participant from guessing information about said particular topic area;

(h) providing a fourth playing category which prevents at least one participant with the greatest number of points from guessing information about said particular topic area;

(i) providing a nonparticipant who recites said particular topic area, at least two participants being given a set period of time to guess information about said particular topic area; and (j) awarding said at least one participant with at least one unit of points if information about said particular topic area is answered correctly.

* * * * *